United States Patent [19]

Baginski

[11] Patent Number: 4,893,563

[45] Date of Patent: Jan. 16, 1990

[54] MONOLITHIC RF/EMI DESENSITIZED ELECTROEXPLOSIVE DEVICE

[75] Inventor: Thomas A. Baginski, Auburn, Ala.

[73] Assignee: The United States of America as represented by the Secretary of the Navy, Washington, D.C.

[21] Appl. No.: 280,049

[22] Filed: Dec. 5, 1988

[51] Int. Cl.[4] ..... F42C 19/12

[52] U.S. Cl. ..... 102/202.2; 102/202.5

[58] Field of Search ..... 102/202.1, 202.2, 202.5, 102/202.9

[56] References Cited

U.S. PATENT DOCUMENTS

| | | | |
|---|---|---|---|
| 3,181,464 | 5/1965 | Parker et al. | 102/28 |
| 3,974,424 | 8/1976 | Lee | 102/202.5 |
| 4,304,184 | 12/1981 | Jones | 102/202.13 |
| 4,378,738 | 4/1983 | Proctor et al. | 102/202.7 |
| 4,708,060 | 11/1987 | Bickes, Jr. et al. | 102/202.5 |
| 4,729,315 | 3/1988 | Proffit et al. | 102/202.5 |

*Primary Examiner*—Charles T. Jordan

*Attorney, Agent, or Firm*—John D. Lewis; Kenneth E. Walden

[57] ABSTRACT

A device to protect electromagnetic devices and the method to manufacture the device is disclosed. The novel structure is inherently immune to sinusoidal radio frequency (RF) radiation, and also offers protection against stray signals induced by RF arcing. A main feature is the monolithic construction which reduces dramatically the coupling area for direct RF radiation. An oxide layer is thermally grown on a silicate substrate to form a dielectric, then a resistive layer of nichrome is sputtered to form a heating element. This process places the resistive bridgewire in direct contact with distributed capacitance.

24 Claims, 1 Drawing Sheet

MONOLITHIC RF/EMI DESENSITIZED ELECTROEXPLOSIVE DEVICE

The U.S. Government has rights in this invention pursuant to Contract No. N60921-87-D-315 between Southeastern Center for Electrical Engineering Education and the U.S. Department of Defense under delivery order No. B004.

BACKGROUND OF THE INVENTION

The present invention relates to electroexplosive devices (EEDs) such as detonators, blasting caps and squibs. More particularly, this invention relates to a method and device for desensitizing EEDs to electromagnetic radiation and electrostatic charges, thus preventing the premature or inadvertent detonation thereof.

A variety of propulsion systems and ordnance depend upon an electrical signal to initiate combustion. This signal is typically a dc current. The current flows through a conductor (typically a bridgewire supported between two posts) which causes a rapid temperature rise via ohmic heating. Once the conductor reaches a sufficiently high temperature it ignites nearby material. The ignited material is then used to initiate combustion of secondary material. The device which consists of the conductor and primary combustionable material is referred to as an electroexplosive device (typically referred to as an EED or squib).

Over the past four decades the electromagnetic environment of an electroexplosive device has changed dramatically. The operation of high-power radar and communication equipment has introduced high-intensity electromagnetic fields to the environment.

The fields can be coupled into an electroexplosive device. The methods of coupling are direct radio frequency (RF) radiation (e.g., the EED acts as the load of a receiving antenna) and arcing associated with weapons procedures such as the attachment of an umbilical cable. These two events will be referred to as electromagnetic interference (EMI).

A prime hazard of the conventional EED is that a coupled signal (caused by either direct RF radiation or arcing) will heat the bridgewire sufficiently to cause accidental firing.

Additional difficulties associated with the bridgewire include an EED that will not fire after exposure to electromagnetic interference (EMI) or severe mechanical stress. The mechanical stress of the EED includes severe vibration during flight and transport, and thermal stress induced by heating and cooling as the EED changes environments.

The former failure results from the bridgewire burning in two at a "hot-spot". The latter is caused by the wire breaking off at a support post.

This disclosure discusses a novel EED structure which is inherently immune to stray electromagnetic fields whether they be directly coupled or caused by inadvertent arcing. Additionally, the structure will not fail to ignite after EMI exposure or severe mechanical stress.

Various methods have been used to alleviate the problem of misfiring caused by electromagnetic radiation. Prior art systems have included inductive and capacitive components that form a balanced bridge or a tank to shunt unwanted signals from the bridgewire. One such protection device is disclosed in Parker et al., U.S. Pat. No. 3,181,464 issued May 4, 1965, which employs special conductors. Parker is used with EEDs having an exploding bridgewire. Other prior art devices add discrete components such as capacitors and inductors to form RF filters or otherwise electronically shunt unwanted signals away from the bridgewire. For example, Jones, U.S. Pat. No. 4,304,184 uses one or more inductors and ferrite beads to oppose and/or absorb unwanted current flow. Proctor et al., U.S. Pat. No. 4,378,738 passes the leads through ferrite chokes.

These prior art devices are often unsuitable for commercial production because of high manufacturing costs, and the constant downsizing of ordinance requires a greater degree of miniaturization than is possible with ferrite material and/or discrete inductors or capacitors. The degree of protection required is also expanding as the radio frequency interference/electromagnetic interference (RFI/EMI) environment becomes more hostile, e.g., a carrier deck with various fire control and navigation radar systems sweeping the ordnance at close range. In this hostile environment all frequencies may have high power. The protection must be broad band and capable of handling high induced currents. It is also increasingly important that the conducting area between the protective device and the bridgewire be reduced as currents adequate to misfire can be induced in conductors or ever-decreasing size as power in the EMI/RFI environment increases.

Another corollary to the EMI/RFI environment becoming increasingly hostile to ordnance on the carrier decks is a need to protect all ordnance aboard the ship and associated aircraft and not just missiles and large explosives. Even the 20 and 30 millimeter cannon rounds, and for that matter, all electrically fired ammunition, independent of size or type, needs protection against environment induced firing. State of the art devices and techniques involving discrete components and/or ferrites are all too bulky to be incorporated in small calibre ordnance.

As a result, a new design for a miniaturized, highly effective protective device is needed.

SUMMARY OF THE INVENTION

Accordingly, it is an object of this invention to provide a RF protection device that is also an EED.

Another object of the instant invention is to provide a protection device for EEDs that effectively isolates the heating element from induced electromagnetic interference.

A further object of the present invention is to provide an RFI/EMI protection device that is miniaturized.

Yet another object of the present invention is to teach a device that may be incorporated into small calibre ammunition.

Still another object of the present invention is to disclose a method of constructing a miniaturized monolithic RF/EM protection EED.

Another object of the present invention is to produce a protection device for ordnance that is low in manufacture costs.

Yet another object of the present invention is to provide an EED protection device that is electrically and physically in close proximity to the bridgewire, thus reducing the coupling area for direct RF/EMI radiation.

Still another object of this invention is to teach an EED protection device that decreases the chances the EED will inadvertently fire or dud when exposed to radio frequency, microwave or electromagnetic radiation.

Another object of the present invention is to teach a monolithic RF/EMI protection device not subject to physical separation from the heating element.

A further object of the present invention is to teach a monolithic RF/EMI protection device which includes the heating element integral with the device.

A still further object of the present invention is to teach a device for RF/EMI protection of ordnance which has an enhanced ability to withstand vibration and stress.

Yet another object of the present invention is to disclose a protection device for ordnance that protects against accidental firing from inadvertent arcing.

Another object of this invention is to provide a protection device that will not fail to ignite when receiving a firing signal after EMI exposure or severe mechanical stress.

Accordingly, a monolithic protective device and method of manufacture thereof is hereinbelow disclosed which accomplishes all the above listed objects. The specific nature of the invention as well as other objects, uses and advantages thereof will clearly appear from the following description and from the accompanying drawings, in which:

DETAILED DESCRIPTION OF THE INVENTION

Figure 1:
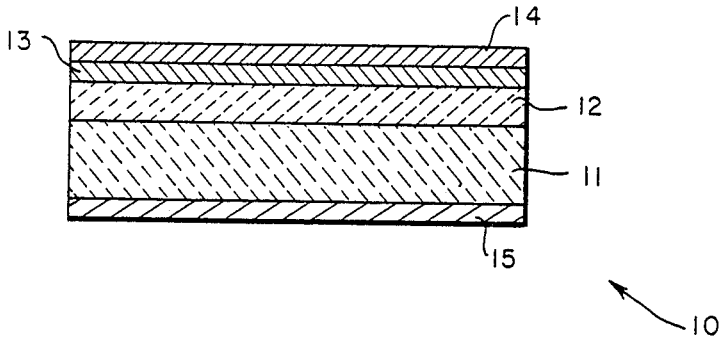
FIG. 1 is a pictorial representation delineating the differet layers of material used to form the monolithic protection device.

Referring now to the drawings, there is shown in FIG. 1 a monolithic protection device of this invention designated generally with the numeral 10. Starting material for the structure was a <100> oriented, 3 inch diameter, 18 mill thick p-type silicon wafer 11, widely available from multiple commercial sources. Wafer 11 was then thermally oxidized to form a circa 1000 angstrom thick layer of silicon dioxide ($SiO_2$)12. Either a wet-oxide or dry oxygen method may be employed to grow silicon dioxide layer 12 by exposure 30 to 90 minutes at 900–1200 degree centigrade baking. This silicon dioxide layer 12 forms a superb dielectric material and its permittivity remains constant well into the GHZ region.

Next a layer of nichrome 13, approximately 1000 angstroms thick, was sputtered onto silicon dioxide layer 12 to form a resistive layer 13 to function as the heating element. Nichrome was chosen from convention, as nichrome is commonly used as bridgewire material. It should be understood that other resistive materials may be utilized without departing from the scope of the invention.

It should be noted that an ultra-thin layer of chromium, less than 50 angstroms thick, might be sputtered on silicon dioxide layer 12 to form an enhanced bonding surface for resistive layer 13.

A low resistivity layer of copper 14 was next sputtered onto nichrome layer 13. Copper was chosen for convenience and solderability as the firing leads attach to copper layer 14. Finally, a layer of aluminum 15 was evaporated onto the backside of the silicon wafer to provide an ohmic contact to the structure.

Figure 2:
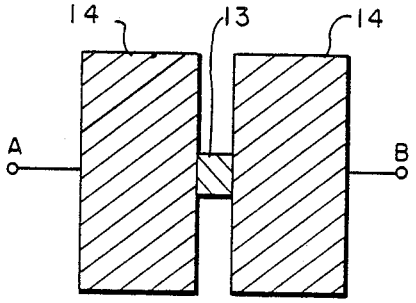
FIG. 2 is a partial representation of the device of FIG. 1 showing the copper contact pads with the nichrome heating element.

FIG. 2 shows the structure of FIG. 1 after copper layer 14 and nichrome layer 13 were selectively etched to form the pattern of FIG. 2. After etching the copper contact pads, leads A and B will connect to the firing leads of the device.

The preferred method of forming the monolithic structure is outlined below:

first provide a substrate of silicon 11 to be processed; then thermally grow an oxide layer 12 to form a dielectic of silicon dioxide by either a wet oxide or dry oxygen method in a 900°–1200 C. degree exposure for 30–90 minutes forming an approximately 1000 angstrom layer; then sputter an ultra-thin bonding layer of chromium on layer 12; then sputter a resistive layer of nichrome 13 approximately 1000 angstroms in depth; then pattern nichrome layer 13 by depositing a photo resist material thereon and spinning 1200–3000 RPM for about 15 seconds to remove excess; then bake the photo resist about 30 minutes at 100° C. in a nitrogen environment; then expose photo resist to a pattern of ultraviolet light with approximate wavelength of 300 nm; then develop the photo resist with commercially available photo resistive developer known to those skilled in the art; then etch by submersion into hydrochloric and nitric acid 10 to 15 minutes to remove the nichrome; then sputter copper layer 15 and repeat photoresist, spinning, baking, exposing to ultraviolet and etching to form the desired pattern on the copper.

Figure 3:
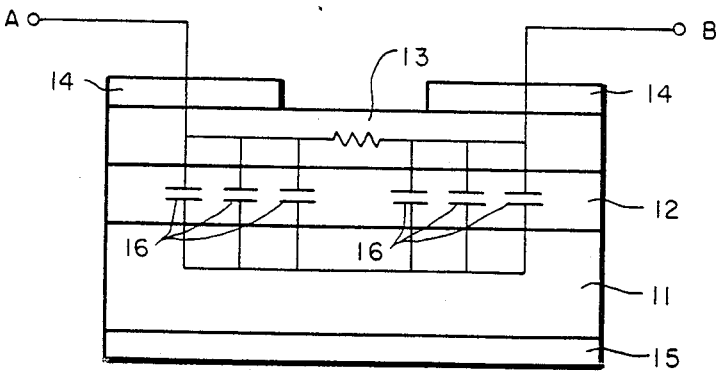
FIG. 3 is a schematic showing the distributed capacitance of the device of FIG. 1.

FIG. 3 shows the distributed capacitance schematic of the device with 16 representing the phantom capacitors.

Figure 4:
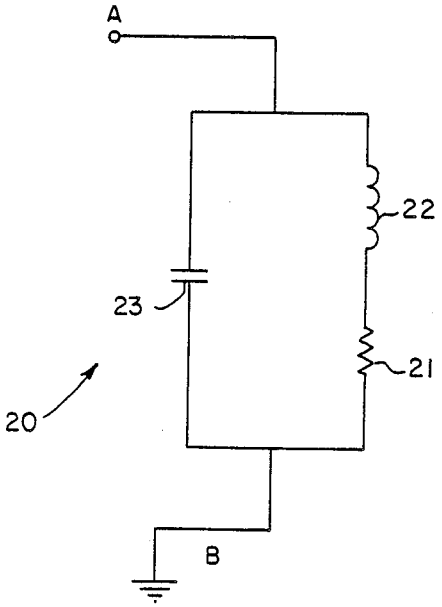
FIG. 4 is a schematic showing the lumped parameters of the device of FIG. 1.

FIG. 4 is a lumped parameter model of the structure wherein 20 designates the electrical function of the device. Therein the resistance of the bridgewire is in series with the inductance while C shunt 23 shunts around the bridgewire. This structure provides desensitivity to EMI due to the following reasons. The metal areas over the $SiO_2$ form a distributive capacitive structure 16 without discrete elements to vibrate loose. All interconnects are planar and offer exceptional reliability and long term stability.

The processing irregularities which can occur during wire drawing through a die include contamination, thickness variations and a variety of material defects such as dislocations. All these inhomogenetics can result in a small volume of the wire having significantly different characteristics than the bulk. When a EMI signal is passed through the wire the element may literally burn in two at the inhomogeneity though not ignite the EED. The result of this event is a squib which is now a dud and will not fire.

The advantage of using the planar sputtering technology of the present invention to fabricate the resistive element is that the technique produces films with exceptional purity, stoichiometry, and uniform thickness. The effect is to eliminate processing inhomogeneities that can later result in failures.

The arcing problem encountered when ordnance such as a rocket is loaded or unloaded from an aircraft may be addressed by utilizing high K dielectric ceramic capacitors (not shown) to absorb the energy of an arcing event. In an arc, the signal which is coupled into the EED has a wide range of frequency components including dc. All of the energy of the dc signal is almost instantaneously coupled into a conventional bridgewire. Energy per unit time is power, which in our case can be extremely high because of the short time involved in the event. Since the power is high a conventional bridgewire will heat and ignite or dud.

Ceramic capacitors in parallel with the heating element reduce the chances of unwanted ignition. During the arc the dc component of the signal will charge the ceramic capacitors. Essentially, the capacitors act as a sink for the energetic electrons produced by the arc. The capacitor will charge quickly due to a low R-C time product. After the arc the capacitor will discharge through the resistor. The R-C product is much larger for the discharge path. Therefore, the coupled energy is dissipated over a much longer time period. The net result is that the power coupled to the heating element is very low, thus keeping it from heating.

It is considered within the scope of this invention to use the monolithic bridgewire device with or without the ceramic capacitors as required by the environment. If the device is used in ordnance loaded on aircraft operating on a carrier deck where arcing phenomena is experienced then ceramic capacitors in parallel with the bridgewire is considered the best mode to practice the invention.

An alternate method of producing the monolithic device while remaining within the scope of the invention is to:

first provide a substrate of silicon to be processed; then thermally grow an oxide layer to form a dialectric layer of silicon dioxide; then deposit photo resist on the oxide layer and then pattern and develop this layer; then sputter ultra-thin bonding layer; next sputter the nichrome layer; then strip the photo resist by dipping in acetone for approximately 2 minutes which removes chrome and nichrome not bonded to the oxide tracks, then sputter copper; then repeat photo resist, spin, bake, expose and etch to form a pattern on the copper; then evaporate aluminum on the backside of the water if desired.

A third method of manufacturing a monolithic EED disclosed but not claimed is to begin with a monolithic capacitor for a substrate and sputter a nichrome layer on top to form a resistive bridgewire.

It will be apparent that the embodiments shown are only exemplary and that various modifications can be made in construction, materials and methods within the scope of the invention as defined in the appended claims.

What is claimed is:

1. A monolithic RF/EMI desensitized electroexplosive device comprising:

a substrate of silicon, coated on a first side with a layer of silicon dioxide; and a patterned layer of nichrome over said silicon dioxide layer to form a resistive bridgewire; and a pattern layer of copper over said nichrome layer said layer of copper forming lead attachment points for the device.

2. A monolithic electroexplosive device according to claim 1 further defined by a bonding layer of chromium interspaced between said silicon dioxide layer and said nichrome layer.

3. A monolithic electroexplosive device according to claim 2 wherein said bonding layer of chromium is approximately 50 angstroms thick.

4. A monolithic RF/EMI desensitized electroexplosive device according to claim 1 wherein said silicon dioxide layer is circa 1000 angstroms thick; and said nichrome layer is circa 1000 angstroms thick.

5. A monolithic electroexplosive device according to claim 3 wherein said silicon dioxide layer is approximately 1000 angstroms thick; and said nichrome layer is approximately 1000 angstroms thick.

6. A monolithic electroexplosive device according to claim 1 further defined by a layer of aluminum on a second side of said silicon substrate.

7. A monolithic electroexplosive device according to claim 2 further defined by a layer of aluminum on a second side of said silicon substrate.

8. A monolithic electroexplosive device according to claim 5 further defined by a layer of aluminum on a second side of said silicon substrate.

9. A monolithic electroexplosive device according to claim 1 wherein one or more ceramic capacitors are operatively connected in parallel with said patterned layer of nichrome.

10. A monolithic electroexplosive device according to claim 2 wherein one or more ceramic capacitors are operatively connected in parallel with said patterned layer of nichrome.

11. A monolithic electroexplosive device according to claim 5 wherein one or more ceramic capacitors are operatively connected in parallel with said patterned layer of nichrome.

12. A monolithic electroexplosive device according to claim 8 wherein one or more ceramic capacitors are operatively connected in parallel with said patterned layer of nichrome.

13. A method of manufacturing a monolithic RF/EMI desensitized electroexplosive device comprising the steps of:

(a) providing a substrate of silicon; then (b) growing an oxide layer of silicon dioxide by an oxide enhancement method of exposing the substrate to 900–1200 degrees for 30–90 minutes; then (c) sputtering a resistive layer of nichrome on the silicon dioxide layer, then (d) depositing a photo resist material on the layer of nichrome, then (e) spinning the device for circa 15 seconds to remove excess photo resist material; then (f) baking the device at an approximate temperature of 100° centigrade for about 30 minutes; then (g) exposing the photo resist to a pattern of ultraviolet light having a wavelength of about 300 nm; then (h) exposing the device to a developer; then (i) etching the device by submersion into hydrochloric and nitroc acid 10–15 minutes; then (j) sputtering a layer of copper over the nichrome layer; then (i) repeating said steps (d) through (i).

14. A method according to claim 13 wherein step (b) is performed by a wet oxygen enhancement method.

15. A method according to claim 13 wherein step (b) is performed by a dry oxygen enhancement method.

16. A method according to claim 13 wherein step (b) exposes the substrate to the 900–1200 centigrade heat for a period of time resulting in a layer of silicon dioxide approximately 1000 angstroms thick.

17. A method according to claim 13 wherein said step (c) results in a layer of nichrome approximately 1000 angstroms thick.

18. A method according to claim 13 further defined by a step of sputtering a thin bonding layer of chromium between said step (b) and said step (c).

19. A method according to claim 13 further defined by a final step (l) of evaporating a layer of aluminum on the back of the silicon substrate.

20. A method according to claim 18 further defined by a final step of evaporating a layer of aluminum on the backside of the aluminum substrate.

21. A method of manufacturing a monolithic RF/EMI desensitized electroexplosive device comprising the steps of:

providing a substrate of silicon to be processed; then growing an oxide layer of silicon dioxide on a first side of the substrate by exposing the substrate to a thermal oxidation method; then depositing photo resist on the silicon dioxide layer; then developing the device; then sputtering a layer of nichrome; then stripping the photo resist by dipping the device in acetone for approximately two minutes; then sputtering a layer of copper on the device; then repeating said steps of depositing photo resist and developing the device.

22. A method according to claim 21 wherein said developing steps comprise the process of spinning the device to remove excess photo resist material;

baking the device at about 100° centigrade for approximately 30 minutes;

exposing the baked photo resist to an ultraviolet light with a wavelength of approximately 300 nm; and exposing the device to a developer before finally etching.

23. A method according to claim 22 further defined by an additional step of evaporating a layer of aluminum on a second side of the silicon substrate.

24. A method according to claim 21 further defined by an additional step of sputtering a bonding layer of chromium on the silicon dioxide between said steps of developing the device and sputtering a layer of nichrome.

* * * * *